US005983770A

United States Patent [19]

Helgren et al.

[11] Patent Number: 5,983,770

[45] Date of Patent: Nov. 16, 1999

[54] RESEAL WITH A PARTIAL PERFORATION AND METHOD AND APPARATUS FOR CREATING A PARTIAL PERFORATION IN A RESEAL

[75] Inventors: R. Hayes Helgren, Mundelein; Charles C. Valentincic, Waukegan, both of Ill.

[73] Assignee: Abbott Laboratories, Abbott Park, Ill.

[21] Appl. No.: 08/806,001

[22] Filed: Feb. 24, 1997

Related U.S. Application Data

[63] Continuation of application No. 08/285,582, Aug. 3, 1994, abandoned.

[51] Int. Cl.[6] ..... B26F 1/18

[52] U.S. Cl. ..... 83/868; 83/34; 83/39; 83/175; 83/176; 83/660; 264/138; 264/293

[58] Field of Search ..... 83/868, 861, 866, 83/17, 18, 20, 34, 39, 30, 175, 660, 176; 215/247, 310; 220/229; 225/93, 94, 96, 96.5, 101, 103; 264/138, 293, 154; 53/488, 489, 319, 320, 420, 329.2, 329.3, 557

[56] References Cited

U.S. PATENT DOCUMENTS

| | | | |
|---|---|---|---|
| 1,180,665 | 4/1916 | McElroy | 215/247 |
| 1,545,332 | 7/1925 | Kase . | |
| 2,219,755 | 10/1940 | Skold . | |
| 2,242,645 | 5/1941 | Frost . | |
| 2,293,721 | 8/1942 | Engler . | |
| 2,612,950 | 10/1952 | Ewing . | |
| 2,906,423 | 9/1959 | Sandhage | 215/247 |
| 3,217,574 | 11/1965 | Nauta et al. | 83/176 X |
| 3,459,350 | 8/1969 | Wahn | 225/93 |
| 3,751,552 | 8/1973 | Meadors | 264/293 |
| 5,267,966 | 12/1993 | Paul | 604/167 |
| 5,403,293 | 4/1995 | Grabenkort | 604/284 |

FOREIGN PATENT DOCUMENTS

| | | |
|---|---|---|
| 308815 A2 | 3/1989 | European Pat. Off. . |
| 416467 A2 | 3/1991 | European Pat. Off. . |
| 544653 A2 | 6/1993 | European Pat. Off. . |
| 93/11828 | 6/1993 | WIPO . |
| 93/19905 | 10/1993 | WIPO . |

*Primary Examiner*—Rinaldi I. Rada
*Assistant Examiner*—Charles Goodman
*Attorney, Agent, or Firm*—Daniel J. Hulseberg; Brian R. Woodworth

[57] ABSTRACT

A reseal is partially perforated by stretching the reseal membrane, establishing contact between one side of the membrane and an anvil, and by effecting partial penetration of the membrane with at least one cutting edge from the other side of the membrane to a predetermined distance from the anvil. Multiple partial perforations may be made with one or more cutting edges.

16 Claims, 8 Drawing Sheets

FIG. 6
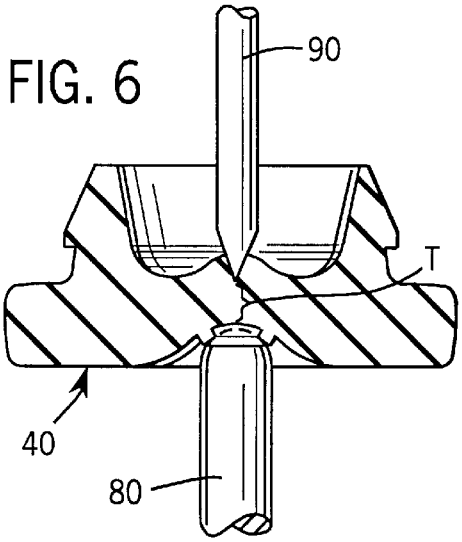
FIG. 8
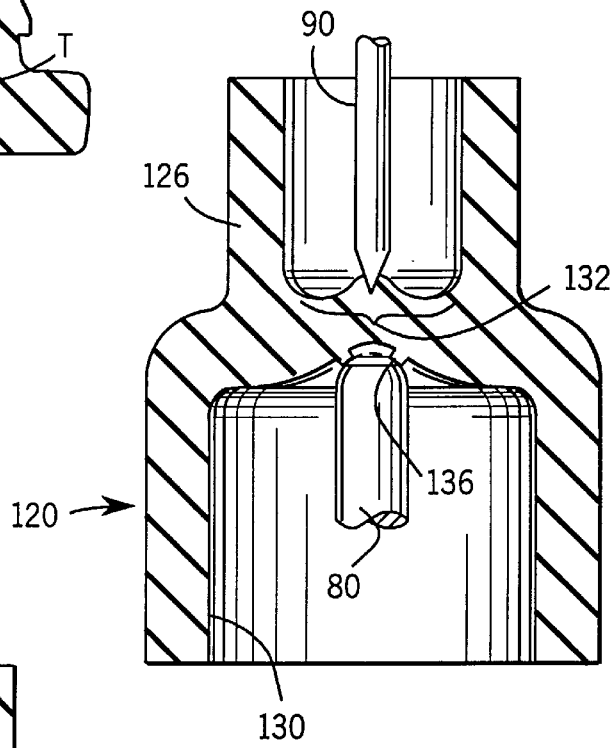
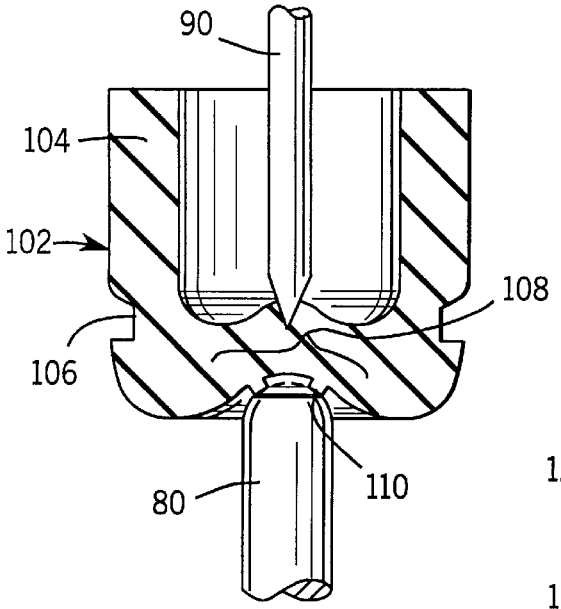
FIG. 7
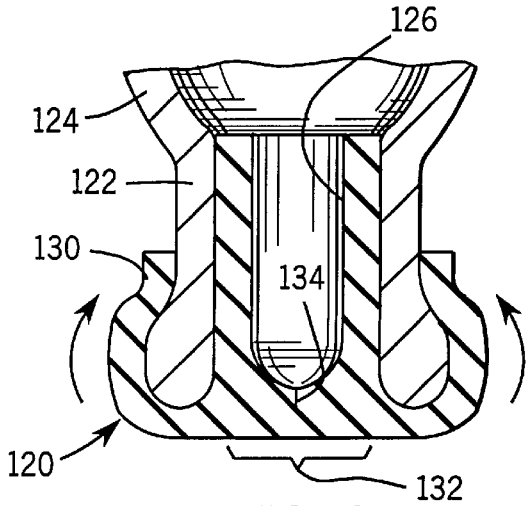
FIG. 9

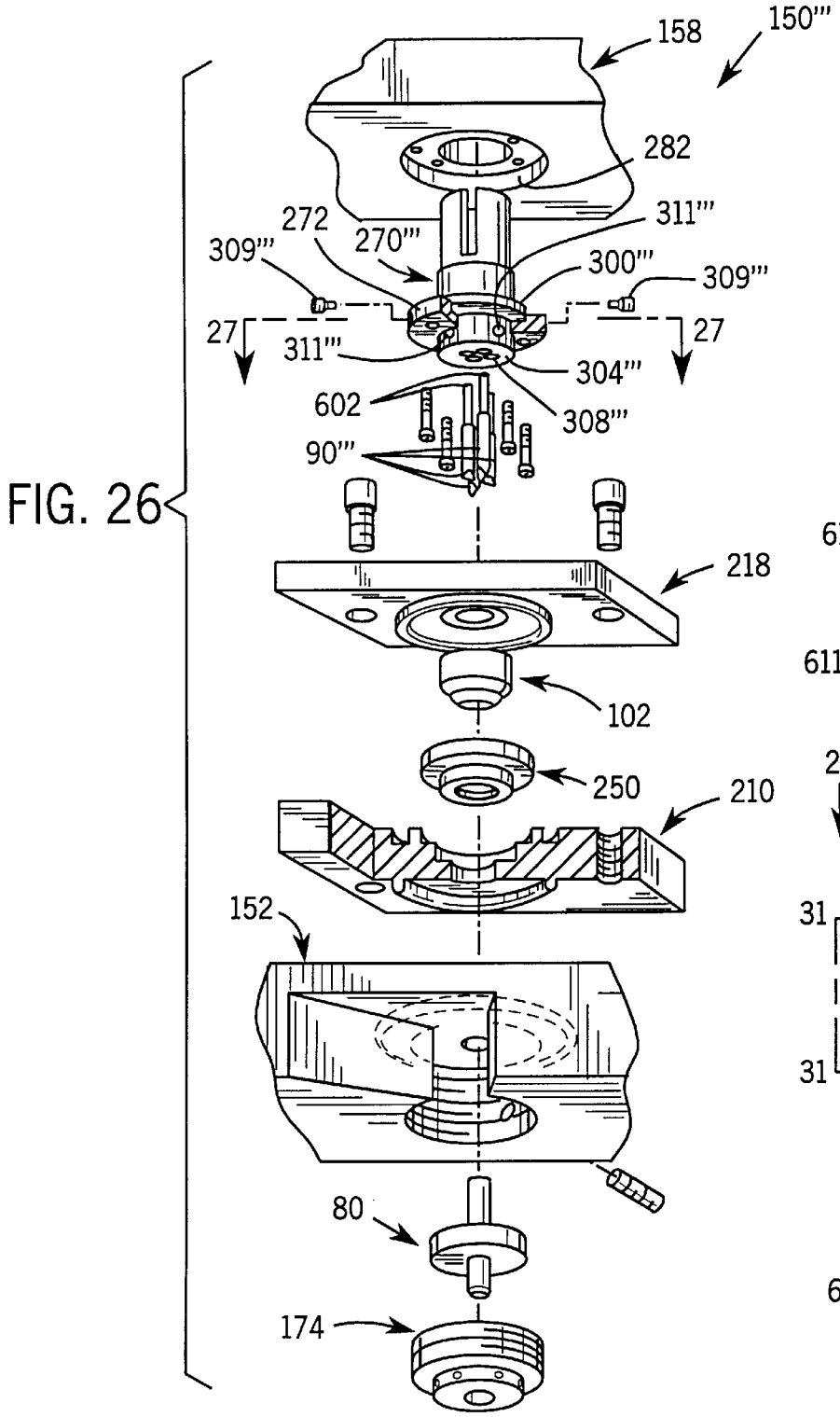
FIG. 26
FIG. 28
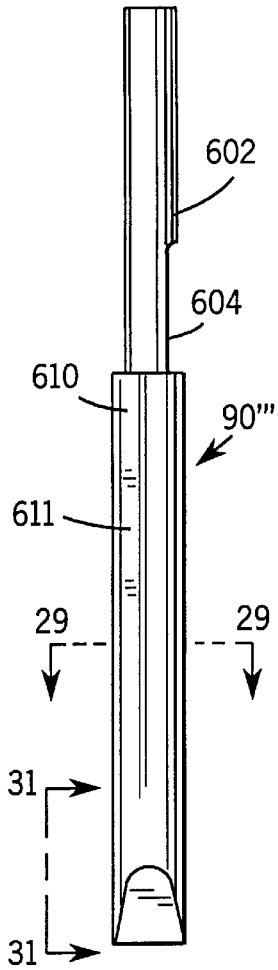
FIG. 29
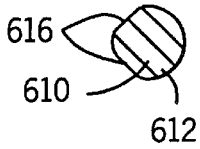

RESEAL WITH A PARTIAL PERFORATION AND METHOD AND APPARATUS FOR CREATING A PARTIAL PERFORATION IN A RESEAL

This application is a continuation of U.S. Ser. No. 08/285,582, filed Aug. 3, 1994, now abandoned.

TECHNICAL FIELD

The present invention relates to a method and apparatus for creating a partial perforation in the membrane of a reseal and relates to a reseal made by such a method. The invention is particularly well-suited for creating a reseal with a more controlled or more accurately predetermined penetration resistance force that must be overcome by a cannula being inserted through the reseal. The invention is also well-suited for providing a reseal having special configurations of partial perforations.

BACKGROUND OF THE INVENTION AND TECHNICAL PROBLEMS POSED BY THE PRIOR ART

Reseal members or reseals are in wide-spread use in the health care industry on liquid containers, and such reseals typically accommodate the insertion of a needle or cannula through which liquid can be added or withdrawn from the container.

Typically, reseals are used on containers such as vials or flexible bag-type containers of liquids such as medicaments or parenteral solutions and the like. Such reseals are also incorporated in Y-sites of tubing sets for infusion. The reseals provide easy access to the solution or other liquid by use of a hypodermic needle or cannula which punctures the reseal and which is inserted therethrough.

Reseals are typically fabricated from natural rubber. This material has the inherent property of retaining its shape after it is punctured. As such, it provides an excellent seal for a container subsequent to initial puncture when the cannula is inserted and even after the cannula is withdrawn.

Some conventional reseals have a completely solid membrane which must be punctured by the cannula. Other conventional reseals are pre-slit to facilitate cannula penetration. The type of reseal with a solid membrane is, of course, preferably used in those applications wherein the likelihood of contaminant ingress must be minimized as much as possible.

In order to minimize the likelihood of punctures in a person's skin resulting from misuse of sharp cannulas in the performance of health care procedures, the use of "blunt," relatively unsharpened cannulas is becoming increasingly prevalent. One of the design criteria which must be accommodated in connection with the use of blunt cannulas relates to the piercing force required to insert the cannula through a reseal. Typically, a substantial force must be applied to the blunt cannula to puncture the reseal, especially, the type that is not pre-slit.

In order assist the user in properly puncturing and penetrating the reseal with a blunt cannula, it has been determined that the central portion or membrane of the reseal may be provided with a partial slit according to the principles of the present invention. In particular, a slit extends from the inner surface of the reseal membrane, but only partially through the thickness of the membrane.

A sufficient thickness of the membrane is left uncut to provide the necessary sealing function and to provide sufficient resistance to penetration for preventing inadvertent puncturing of the reseal. A partial slit will allow the unslit portion of the reseal membrane to function initially as an effective barrier against contaminant ingress. The partial slit permits a thicker membrane to be used so that after puncture by the cannula, there is a sufficient thickness of material to provide adequate or enhanced sealing and resistance to contaminant ingress either with the cannula inserted or with the cannula withdrawn.

The partial slit or cut extending from the inner surface of the reseal membrane weakens the membrane and provides a preferential puncture region as the membrane is deformed inwardly by the tip of the blunt cannula.

More particularly, the penetrating cannula stresses the reseal membrane until the ultimate stress in the uncut thickness of material is reached. At that point, the uncut portion of the reseal membrane ruptures, and the cannula passes through the reseal membrane.

The process by which the blunt cannula penetrates the reseal membrane is dependent upon the reseal membrane thickness, the depth of the partial perforation or slit, the elastic modulus of the material, the lubricity of the material, the size and shape of the cannula, and other factors. For a given set of values for these parameters, it is desirable to provide a reseal design wherein all of the reseals of that design will require substantially the same force to achieve penetration by a blunt cannula. This will permit the reseal manufacturer to be more certain of the integrity of the reseal as manufactured. Also, this will be helpful to the user who can learn to expect that a particular amount of force will be required to puncture a particular type of reseal with the cannula.

One of the factors which significantly affects the puncturing force required is the thickness of the uncut or unslit portion of the reseal membrane above the partial perforation or slit. Because the reseal membrane is an elastic material, typically a natural rubber, the manufacturing of the membrane with a specific membrane thickness and a specific uncut thickness below the initial, partial perforation is difficult from the standpoint of providing a uniform or consistently identical structure in each reseal that is manufactured.

In particular, the partial perforation is formed in the reseal membrane by moving a lance or other cutting edge partially into the reseal membrane. Due to manufacturing tolerances in the molding of the membrane and the resilient nature of the membrane material, the thickness of the uncut material in the membrane above the partial perforation or slit could vary from reseal to reseal. Accordingly, it would be desirable to provide a system for more accurately controlling the thickness of the uncut material in the reseal membrane above the partial perforation.

It would also be advantageous to provide the capability for creating different partial perforation configurations in the reseal membrane. For example, it would be desirable to provide improved, larger partial perforations that establish a larger or specially defined target area.

It would also be beneficial if an improved partial perforation configuration could be provided with enhanced sealing capabilities.

The present invention provides an improved reseal, a method for making the reseal, and an apparatus for making the reseal which can accommodate designs having the above-discussed benefits and features.

SUMMARY OF THE INVENTION

The present invention, in one preferred form, provides a partially perforated reseal. The invention also preferably provides a method and apparatus for making such reseals with a reduced variation in the uncut thickness of the reseal membrane so as to provide more consistent penetration resistance.

The invention also provides a novel reseal, as well as a method and apparatus for accommodating the manufacture of a reseal, wherein the reseal has one of a number of special, partial perforation configurations which provide more effective target areas and/or enhanced sealing capabilities.

According to one aspect of one form of the method of the present invention, the membrane of the reseal is stretched while contact is established between one side of the membrane and an anvil. Partial penetration of the membrane is effected from the other side of the membrane with at least one cutting edge to a predetermined distance from the anvil. Preferably, the membrane is stretched to elevate the tensile stress in the membrane to less than, but within 10% of, the ultimate stress of the membrane material.

According to another aspect of the invention, the reseal membrane is stretched while subjecting a face of the membrane to either a shear load or a torsion load. Then partial penetration of the membrane is effected with at least one cutting edge to a predetermined distance from the anvil.

When the stretching of the membrane is terminated after cutting the membrane, the partial perforation defined in the relaxed membrane has a different configuration compared to the configuration that existed when the membrane was stressed. The relaxed configuration can provide enhanced sealing capabilities and/or different or improved target areas.

According to yet another aspect of the present invention, a reseal with an elastic seal membrane is provided in which the membrane includes a partial perforation created by the process comprising the steps of (A) stretching the membrane, (B) establishing contact between one side of the membrane and an anvil, and (C) effecting partial penetration of the membrane with at least one cutting edge from the other side of the membrane to a predetermined distance from the anvil.

According to another aspect of the invention, a reseal with an elastic seal membrane is provided with a partial perforation created by the process comprising the steps of (A) stretching the membrane while subjecting a face of the membrane to either a shear load or a torsion load, and (B) effecting partial penetration of the membrane with at least one cutting edge to a predetermined distance from the anvil.

According to another aspect of the present invention, an apparatus is provided for creating a partially perforated elastic seal membrane in a reseal. The apparatus includes a clamp assembly for clamping the periphery of the reseal around at least a portion of the membrane. The apparatus includes an anvil for engaging one side of the membrane.

A positioning means is provided for effecting relative movement between the anvil and the clamp assembly to stretch the membrane. This subjects the membrane to a tensile force having a component of force acting at least in a direction generally perpendicular to the thickness dimension of the membrane.

The apparatus also includes a lance defining a cutting edge and includes a mounting structure for holding the lance adjacent the other side of the reseal.

Finally, the apparatus includes a drive means for effecting relative movement between the lance on the one hand and the anvil, clamping assembly, and reseal on the other hand so as to effect partial penetration of the membrane with the cutting edge to a predetermined distance from the anvil.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 6 is a view similar to FIG. 5 and illustrates a still further step in the method illustrated in FIGS. 4 and 5;

FIG. 7 is a view illustrating a method step analogous to that shown in FIG. 6, but the method in FIG. 7 is employed with a reseal of the additive port type;

FIG. 8 is a partial, cross-sectional view showing a method step analogous to that illustrated in FIG. 6, but FIG. 8 shows the method step performed on a down port or sleeve stopper type of reseal;

FIG. 9 is a reduced, cross-sectional view of the completed reseal illustrated in FIG. 8, but FIG. 9 shows the reseal as installed in a container port;

FIG. 26 is a exploded perspective view showing an alternate embodiment of the apparatus illustrated in FIG. 10 wherein the apparatus is adapted to employ four lances.

FIG. 28 is a greatly enlarged side elevational view of a lance;

FIG. 29 is a cross-sectional view taken generally along the plane 29—29 in FIG. 28;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of some forms of this invention are described in a typical operating position, and terms such as upper, lower, horizontal, etc., are used with reference to this position. It will be understood, however, that the components and articles of this invention may be manufactured, stored, transported, used, and sold in orientations other than the positions described.

Figures illustrating the method and apparatus of the invention show some mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

Figure 1:
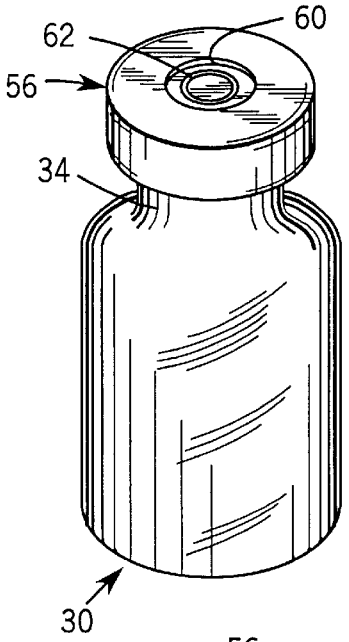
FIG. 1 is a perspective view of an exemplary vial with a ferrule securing a stopper type reseal which embodies the principles of the present invention.
Figure 2:
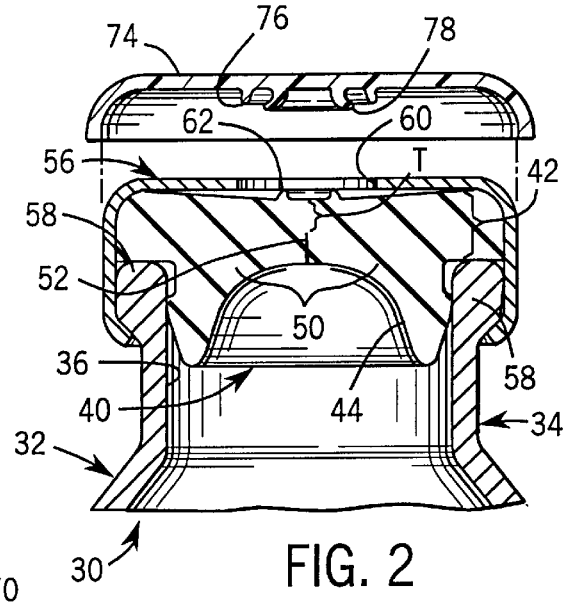
FIG. 2 is a fragmentary, greatly enlarged cross-sectional view of the vial, ferrule, and reseal of FIG. 1, but FIG. 2 further shows a protective cover which may be applied.

With reference to the drawings, FIG. 1 illustrates an exemplary vial 30 for containing a liquid, such as a liquid drug, liquid medicament, solution, or other liquid. As shown in FIG. 2, the vial 30 includes a rigid body 32 terminating in a neck 34 defining an opening 36 which is occluded by a reseal 40 in the form of a stopper.

The stopper reseal 40 has a peripheral flange or enlarged region 42 seated on the distal end of the container neck 34. The stopper reseal has an inwardly projecting plug portion 44 for engaging the interior surface of the container neck 34. The stopper reseal 40 also defines a central region or membrane 50.

The stopper reseal 40 is preferably secured to the container neck 34 with a peripheral ferrule 56 which is deformed around the upper, peripheral portion of the stopper reseal 40 and around a bead formation 58 on the container neck 34. The ferrule 56 preferably defines a central opening 60 which exposes a portion of the upper, or exterior, surface of the stopper reseal membrane 50. Preferably, the upper surface of the reseal membrane 50 defines an annular ring 62 defining a "target" region against which the distal end of a blunt cannula 70 (FIG. 3) can be initially positioned.

In one preferred application, a protective cover 74 is provided for fitting on the outside of the ferrule 56. The cover 74 has a downwardly projecting, central, annular outer flange 76 for fitting within the ferrule opening 60, and the cover 74 also has a downwardly projecting, annular inner flange 78 for engaging the outer, exterior, annular surface of the stopper reseal target ring 62. The cover 74 is typically removably retained on the ferrule 56, as by crimping, with adhesive, or with a friction fit.

Figure 3:
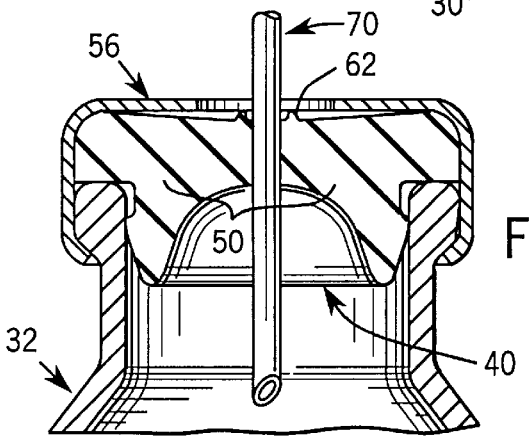
FIG. 3 is a view similar to FIG. 2, but with the protective cover removed and showing a blunt cannula inserted through the reseal.

To use the vial 30, the protective cover 74 is removed to expose the target ring 62 on the upper, exterior surface of the stopper reseal membrane 50. The blunt cannula 70, as illustrated in FIG. 3, can be then forced against the surface of the stopper reseal membrane 50 inside the target ring 62.

Insofar as the stopper reseal 40 has been described, the configuration per se is generally conventional. The stopper reseal 40 is typically fabricated from a resilient material, such as a natural rubber material which may be gum rubber or the like.

According to the present invention, such a reseal can be improved. In particular, the membrane 50 is weakened at a central location with a partial perforation or partial slit 52 which extends from the inside face, surface, or side of the membrane to a predetermined depth within the membrane. An unperforated or unslit thickness T is defined between the inwardmost extension of the slit 52 and the top, or outer, surface of the stopper reseal membrane 50.

When the blunt cannula 70 is pushed against the top of the stopper reseal membrane 50 with sufficient force, the cannula 70 penetrates the membrane 50. Thus, a thicker membrane can be used than would be possible with no partial perforation or slit 52. The thicker membrane provides enhanced sealing and provides an enhanced barrier to contaminant ingress when the cannula is inserted as well as after the cannula is withdrawn.

The unperforated or unslit thickness T of the membrane must be thick enough to withstand fluid pressures in normal handling, but thin enough to be pierced when the cannula 70 is inserted by hand. In one contemplated design, the unslit or unperforated thickness T is preferably about 0.030 inch.

It is desirable to insure the integrity of the reseal construction by providing means for accurately establishing the uncut thickness T during manufacture. It is also desirable that each reseal of a particular design have substantially the same uncut thickness T so that substantially the same force must be applied to the cannula to effect penetration of each reseal. This provides the user with a consistent reaction force from vial to vial, and this thus permits the user to be comfortable with an expected force application requirement for a specific reseal design and cooperating cannula.

Because the reseal is molded from natural rubber, and because the slit 52 must be cut into the natural rubber by forcing a lance against the natural rubber, it can be difficult to insure that the unslit thickness T consistently has the desired dimension. Thus, it would be desirable to employ a cutting process that would minimize variations in the unslit thickness T during the slitting process.

It has been discovered that, according to the present invention, the variation in the unslit thickness T can be significantly reduced by cutting the slit 52 while the reseal membrane 50 is substantially stretched or otherwise subjected to an elevated tensile stress. Preferably, the stress in the membrane is less than, and within 10% of, the ultimate stress of the membrane material.

Figure 4:
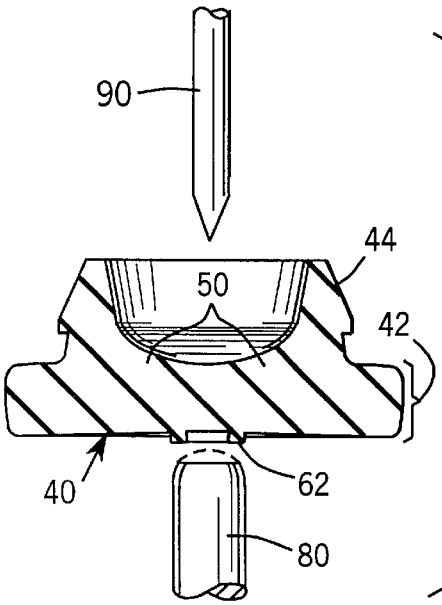
FIG. 4 is a simplified, partially diagrammatic view, partially in cross section, of a step in the method for creating a partial perforation in the membrane of the reseal employed in the constructions illustrated in FIGS. 1–3.
Figure 5:
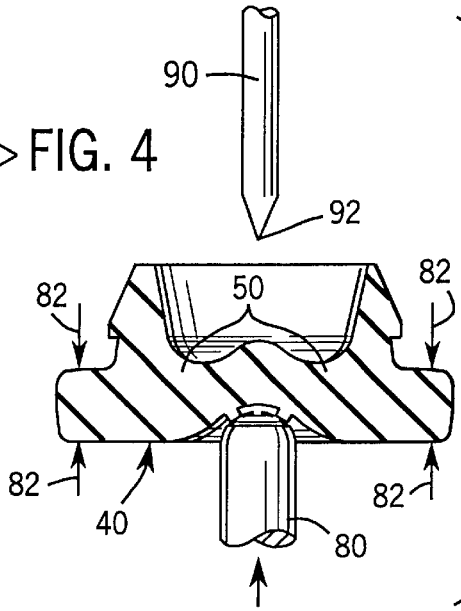
FIG. 5 is a view similar to FIG. 4 and illustrates a further step in the method illustrated in FIG. 4.

More particularly, this process is illustrated for the stopper reseal 40 in FIGS. 4–6. In FIG. 4, the stopper reseal 40, as initially molded without a partial cut or slit, is positioned adjacent an anvil 80. In a preferred form illustrated, the anvil 80 is aligned on the longitudinal axis of the reseal 40. The anvil 80 has a generally flat distal end for engaging the reseal membrane. Typically, the target ring 62 is centrally located and encircles a target region of the membrane surface. However, other anvil end shapes could be provided, such as the hemispherical shape illustrated in dashed lines in FIGS. 4–6. The process may be employed with a reseal that does not have a target ring.

In a preferred form, the reseal 40 is restrained or clamped at its periphery as schematically illustrated in FIG. 5 by opposed arrows 82. The anvil 80 is advanced against the reseal, and the central portion of the reseal member 50 bulges in the direction of the movement of the anvil 80. This action stretches the stopper reseal membrane 50 and elevates the tensile stress (e.g., the radial stress in the membrane thickness adjacent the anvil 80). The tensile stress is elevated to just below the ultimate stress of the material. Then, a lance 90, which is aligned on the longitudinal axis of the reseal 40 and which has a V-shaped cutting edge 92, is advanced into the reseal membrane 50 on the side opposite from the anvil 80. This increases the stress in the reseal membrane 50, and the membrane region contacted by the lance cutting edge 92 fractures and forms a slit.

The advancement of the lance 90 relative to the opposite side surface of the reseal (or, alternatively, relative to the distal end of the anvil 80 or relative to a fixed location or component) is carefully controlled. A position limit stop (not shown in FIGS. 4–6) is preferably employed.

Because the reseal membrane 50 is cut at a higher tensile stress, much better control is obtained relative to the uncut or unslit dimension T of the reseal membrane. Further, less force is required to advance the lance 90 into the membrane. This in some circumstances can reduce the requirement for lubrication of the lance cutting edge and may yield a longer lance life relative to conventional manufacturing techniques.

It will also be appreciated that with the slit cut into the membrane while the membrane is at a higher tensile stress, the slit or cut opens as the lance progresses inwardly. When the lance is withdrawn while the reseal is still under stress from the elevated anvil 80, the cut remains open and can be readily cleaned (e.g., by a de-ionized air jet).

Because the cut or slit is made in the stretched or convex (e.g., bulging) portion of the reseal membrane, a larger (e.g., wider and more robust) lance can be used. This minimizes the tendency of the lance to break. Further, the larger lance provides more cutting edge material that can accommodate sharpening from time to time during the manufacturing process where the same lance is employed to cut many reseals seriatim.

The above-described, novel process can be employed with other types of reseals, such as additive ports and down ports or sleeve type stopper reseals. In particular, FIG. 7 illustrates the process for creating a partially perforated membrane in an additive port reseal 102. The additive port reseal 102 is somewhat similar to the stopper 40 described above with reference to FIGS. 1–6. However, the additive port reseal 102 lacks a radially extending flange and has a somewhat longer portion which is adapted to be inserted into a container. The additive port reseal 102 is typically installed in an additive port or support ring, such as the ring 250 illustrated in FIG. 10 and described in detail hereinafter. The assembly of the reseal 102 and ring 250 is then attached with a heat seal directly in the wall of a flexible bag-type container (not illustrated). The additive port reseal 102 includes a skirt 104 for passing through the wall of the flexible container. An annular groove 106 receives the wall of the container which is sealed to the additive port reseal 102 at the opening in the container wall.

The additive port reseal 102 has a central region or membrane 108 similar to the membrane 50 described above with reference to the stopper reseal 40 illustrated in FIGS. 1–6. The exterior surface of the membrane includes an annular target ring 110 defining the area of the membrane into which a blunt cannula (not shown) is to be inserted.

FIG. 7 illustrates the formation of the partial perforation in the membrane 108 by the advancement of the lance 90 into the bulging, upwardly convex, stretched membrane 108. The advancement of the lance 90 is controlled by a suitable position stop (not shown in FIG. 7). The uncut thickness below the bottom of the slit formed by the lance is more readily and more accurately controlled because of the higher tensile stress existing in the stretched membrane 108.

FIGS. 8 and 9 illustrate a down port or sleeve stopper type of reseal. In FIG. 9, the completed, partially perforated reseal is designated generally by the reference number 120 and is shown installed on the neck 122 of a port member 124 which is attached to the container (not illustrated) by conventional techniques (such as solvent bonding). The sleeve stopper reseal 120 has an inwardly extending plug portion 126 for sealingly engaging the interior cylindrical surface of the container neck 122. The sleeve stopper reseal 120 also has a rollable, flexible flange 130 which can be roller onto the container neck 122 to secure the sleeve stopper reseal 120 in place. A central portion of the sleeve stopper reseal 120 defines a membrane 132 having a partial slit or partial perforation 134 on the interior.

Prior to installation on the container 124, the reseal 120 has a different configuration, generally as illustrated in FIG. 8, wherein the rollable flange 130 projects generally outwardly away from the membrane 132 in the opposite direction from the internal plug 126. Also, as seen in FIG. 8, the reseal 120 may include a target ring 136 on the exterior surface of the reseal membrane 132.

FIG. 8 illustrates the process for cutting the partial perforation or slit in the reseal membrane 132. As with the process used for creating the reseals 40 and 102 described above with reference to FIGS. 1–7, an anvil 80 is advanced against the exterior surface of the reseal membrane 132. The anvil 80 may contact the target ring 136 and/or a portion of the reseal membrane surface within the target ring 136. The reseal membrane 132 is stretched and bulges upwardly in a convex configuration. Then the lance 90 is advanced into the membrane until the leading edge of the lance 90 is at a predetermined distance from the anvil 80 (or, alternatively, the anvil 80 is advanced to a corresponding predetermined point as measured relative to a fixed location).

The above-described process for cutting the partial perforations in the membranes of the reseals 40, 102, and 120 generally contemplates the movement of the anvil 80 against the reseal membrane and the movement of the lance 90 into the reseal membrane. It will be appreciated, however, that the anvil may remain stationary while the reseal is moved against the anvil and that the lance can be subsequently advanced into the reseal. Alternatively, the lance 90 may remain stationary. The anvil 80 would then be advanced against the reseal membrane, and the anvil 80 and stretched reseal could be then moved together, with the reseal in the stretched condition, against the stationary lance 90.

Figure 10:
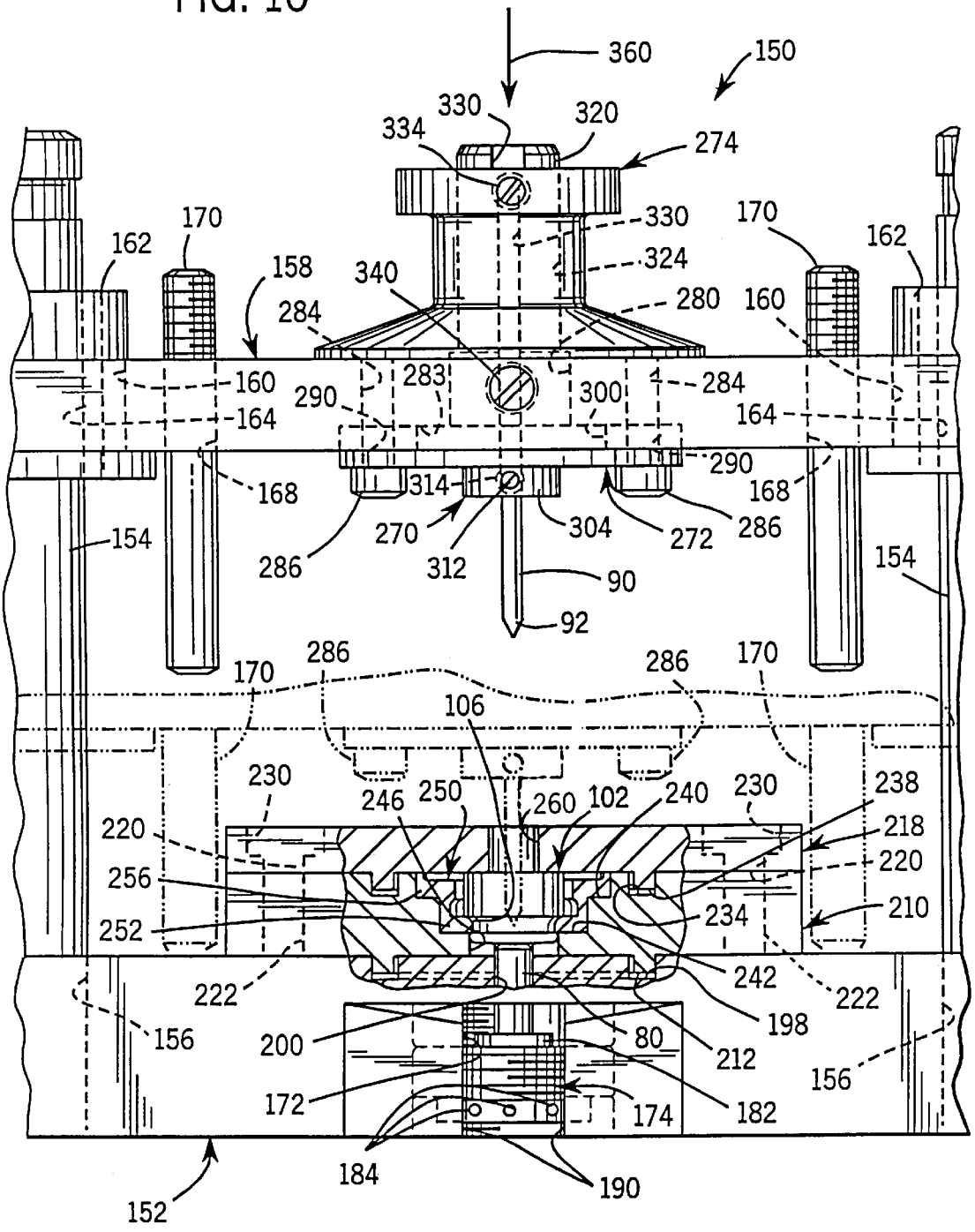
FIG. 10 is a fragmentary, side elevational view of an apparatus for creating a partial perforation in a reseal of the additive port type illustrated in FIG. 7, and a portion of the apparatus in FIG. 10 is illustrated in cross section while a moved position of portions of the apparatus in FIG. 10 is illustrated in phantom by dashed lines.
Figure 11:
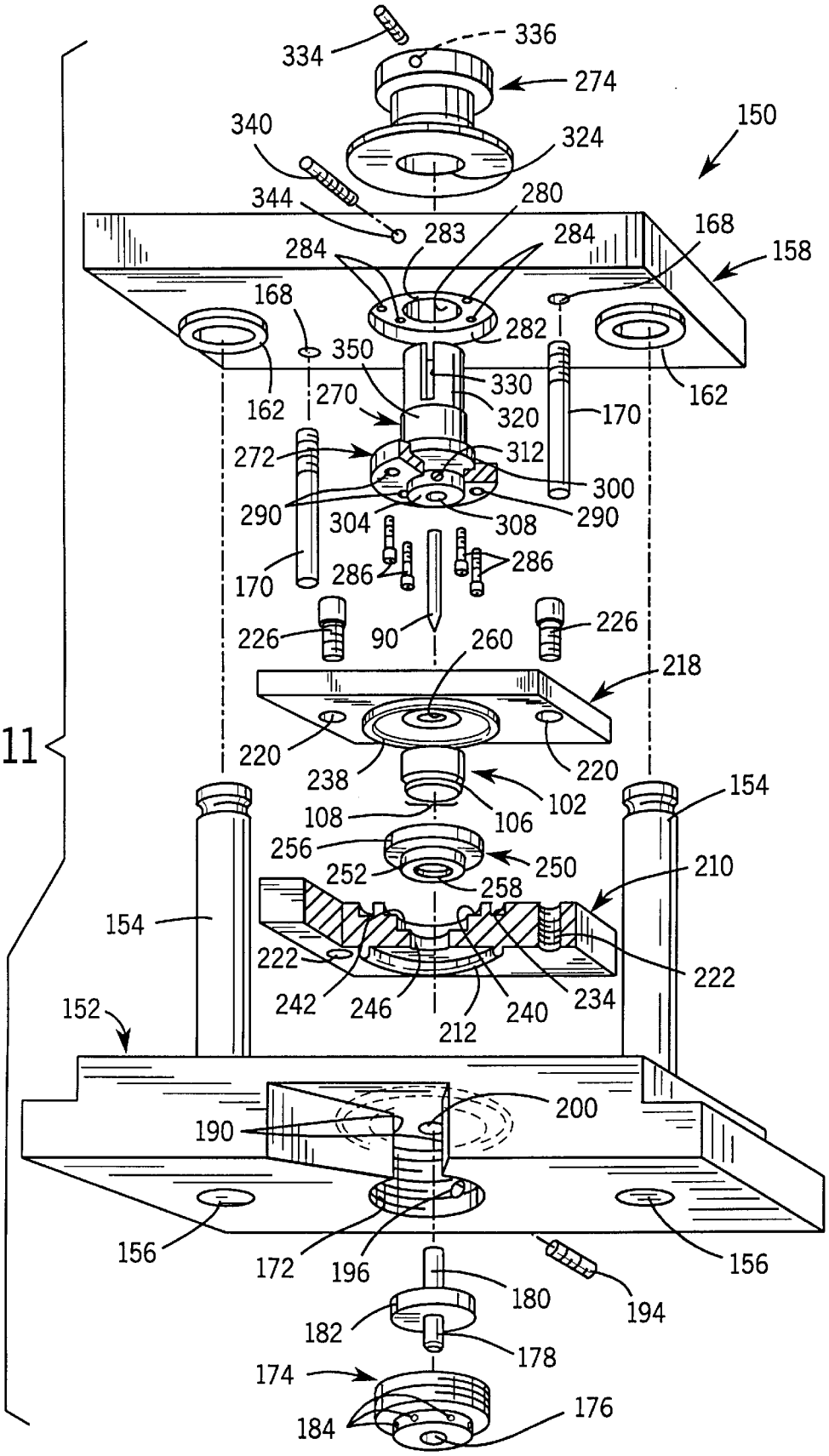
FIG. 11 is an exploded, perspective view of the apparatus shown in FIG. 10.

An apparatus for creating the partial perforation or slit in the elastic seal membrane is illustrated in FIGS. 10 and 11. The apparatus illustrated in FIGS. 10 and 11 is particularly adapted for creating the partial perforation in the additive port reseal 102.

In FIGS. 10 and 11, the apparatus is designated generally by the reference number 150. The apparatus includes a base plate or base 152. A pair of shafts 154 project upwardly from receiving holes 156 in the base 152. A lance support plate 158 is slidably disposed on the shafts 154. To this end, the lance support plate 158 defines a pair of bores 160 (FIG. 10), and a bearing or bushing 162 is disposed within each bore 160 for receiving one of the shafts 154 in a bore 164 defined in the bushing 162.

The lance support place 158 defines a pair of threaded bores 168 for each receiving a threaded stop pin 170. Each threaded stop pin 170 can be threadingly adjusted to move the lower, distal end of the pin 170 upwardly or downwardly so as to establish engagement with the base plate 152 when the lance plate 158 is at a desired, predetermined elevation (as shown in FIG. 10 for the moved position illustrated in phantom by dashed lines).

The base plate 152 defines a central, threaded receiving bore 172 for receiving a threaded adjusting disc 174. The threaded adjusting disc 174 defines a central bore 176 for receiving the lower portion of a generally cylindrical anvil 178 which has an upper, distal end 180 and an intermediate support flange 182. The lower portion 178 of the anvil is received Within the bore 176 of the adjusting disk 174, and the anvil is free to rotate within, and relative to, the disk 174.

The elevation of the disk, and hence of the anvil 80 carried thereon, can be adjusted by engaging an appropriate bore 184 in the disk 174 and then rotating the disk. The disk 174 defines a plurality of equally spaced bores 184 around the circumference. In the preferred embodiment, eight bores 184 are spaced 45 degrees apart. Access to the bores with an appropriate tool is provided by an opening 190 in the side of the base plate 152.

When the adjusting disc 174 is located at the desired elevation within the base plate 152, the disk 174 can be locked at that location with a set screw 194 (FIG. 11). In particular, the base plate 152 defines a transverse, threaded bore 196, and the bore 196 extends from the rear, exterior, vertical surface of the plate 152 to the central bore 172. The set screw 194 is threadingly engaged with the bore 196 and is turned to advance the distal end of the set screw 194 into engagement with adjusting disk 174 to thereby hold the adjusting disk 174 to thereby prevent the disc 174 from being screwed upwardly or downwardly.

The upper surface of the base plate 152 defines an annular groove 198 (FIG. 10) which is concentric with the threaded bore 172. A bore 200 extends from the top of the bore 172 to the upper surface of the base plate 152 for accommodating the projecting distal end of the anvil 80.

An intermediate plate 210 is mounted on the top surface of the base plate 152. The intermediate plate 210 has a downwardly projecting, annular ring 212 for being received within the annular groove 198 defined in the top surface of the base plate 152.

An upper plate 218 is attached to the top surface of the intermediate plate 210. To this end, the upper plate 218 defines a pair of bores 220 which are aligned with threaded bores 222 defined in the intermediate plate 210. Cap screws 226 are provided for extending through the upper plate bores 220 and threadingly engaging the intermediate plate 210 in the threaded bores 222. The upper plate 218 defines counter bores 230 (FIG. 10) for receiving the enlarged heads of the cap screws 226.

The upper surface of the intermediate plate 210 defines an annular groove 234 for receiving a ring 238 projecting downwardly from the bottom surface of the upper plate 218.

The intermediate plate 210 also defines an upwardly open, stepped receiving cavity comprising a first, larger diameter shoulder 240 and a smaller diameter shoulder 242. At the bottom of the cavity, the smaller diameter shoulder 242 communicates with a bore 246 defined in the intermediate plate 210. The bore 246 is aligned with, but has a diameter larger than, the bore 200 in the base plate 152 through which the anvil 80 projects. The anvil 80 extends upwardly into the bore 246 in the intermediate plate 210.

An internal support ring 250 is mounted in the intermediate plate 210. The support ring 250 includes a smaller diameter, cylindrical base portion 252 and a larger diameter, cylindrical upper portion 256. The interior of the support ring 250 is adapted to receive the reseal 102 as illustrated in FIG. 10. The base portion 252 defines a bore 258 through which the closed, membrane end of the reseal 102 can project. The lower portion 252 of the support ring 250 engages the reseal groove 106 as illustrated in FIG. 10 to properly center the reseal within the apparatus. The reseal 102 is further retained by the clamping action of the upper plate 218.

The upper plate 218 defines a central bore 260 to accommodate the downward movement of the lance 90 which is carried on the plate 158 above the upper plate 218. The plate 158 receives a lance carrier 270 which is secured with a retaining ring 272 to the bottom of the plate 158 and which is engaged with an adjusting dial 274 on the top of the plate 158. To this end, the plate 158 defines a central bore 280 and an enlarged, downwardly facing counter bore 282 which communicates with the bore 280. An annular, flat surface 283 between the cylindrical wall of the counter bore 282 and the central bore 280 defines a plurality of threaded bores 284 for each receiving a threaded shank of a cap screw 286. Each cap screw is received in a bore 290 defined in the friction ring 272. The bores 290 are not threaded, and the cap screws 286 thus clamp the friction ring 272 against the lance holder 270 to apply force to the lance holder 270 and retain the lance holder 270 in the plate 158.

The lance holder 270 defines a flange 300 which is received within the counterbore 282 in the bottom of the plate 158 along with the friction ring 272. A central, cylindrical portion 304 projects downwardly from the flange 300 on the interior of the friction ring 272. The portion 304 defines a downwardly open bore 308 for receiving the lance 90. The lance 90 is inserted into the bore 308 to a desired depth and is retained therein with a suitable set screw 312 received in a threaded bore 314 (FIG. 10) extending radially in the portion 304 from the bore 308 through the exterior cylindrical surface of the portion 304.

The lance holder 270 has an upper, reduced diameter cylindrical portion 320 which extends through the bore 280 in the plate 158 and into a bore 324 defined in the dial 274. The bore 324 extends completely through the dial 274, and the cylindrical portion 320 of the lance holder 270 extends beyond the upper end of the dial 274 as shown in FIG. 10. Also, the cylindrical portion 320 of the lance holder 70 defines a vertical slot or keyway 330. The slot 330 receives a distal end of a set screw 334 which is threadingly engaged with a threaded bore 336 (FIG. 11) in the dial 274. This serves to lock the lance holder 270 against rotation about a vertical axis within, and relative to, the dial 274.

Finally, the lance holder 270 can be locked against rotation, when desired, by means of a threaded set screw 340 which is threadingly engaged in a threaded bore 344 (FIG. 11) defined in the front face of the plate 158. The inner end of the set screw 340 extends into the bore 280 in the plate 158 for engaging the cylindrical surface of an intermediate diameter cylindrical portion 350 defined by the lance holder 270 between the upper cylindrical portion 320 and the flange 300.

The dial 274 is provided to permit easy rotation of the lance 90 about its longitudinal axis so as to locate the V-shaped cutting edge 92 in a selected, particular orientation. This is accomplished by first loosening the set screw 340 and then rotating the dial 274 to the desired location. Then the set screw 340 is tightened to lock the lance holder 270 and dial 274 in position.

The plate 158 carrying the lance 90 may be moved upwardly and downwardly relative to the base place (and relative to the reseal 102 mounted therein) manually or by automatic drive systems (e.g., pneumatic or hydraulic operators, electric motors, electric solenoids, etc. (not illustrated)). The detailed design of any such system or systems for moving the lance upwardly and downwardly forms no part of the present invention.

It will be appreciated that when the reseal 102 is properly mounted in the intermediate plate 210, the anvil 80 may be driven upwardly by appropriately rotating the adjusting disc 174 so as to stretch the reseal membrane (as schematically illustrated in FIG. 7). If desired, appropriate automatic mechanisms may be provided for rotating the adjusting disc 174 to raise and lower the anvil 80. Alternatively, the adjusting disc 174 may be completely replaced with some other suitable system for effecting vertical movement of the anvil 80. Alternatively, the height of the anvil 80 may be pre-set and the reseal and clamping plate 218 may be installed afterwards to effect immediate stretching of the membrane. The detailed design and operation of such systems form no part of the present invention.

In order to form a partial perforation or slit in the reseal 102, the stop pins 170 are set to the desired location by effecting appropriate threaded engagement of the pins 170 with the plate 158. The vertical locations of the pin 170 are set relative to the projecting length of the lance 90 and relative to the location of the anvil 80 when the anvil 80 is raised to the uppermost position to stretch the reseal membrane (as diagrammatically illustrated in FIG. 7).

With the stop pins 170 properly located, the anvil 80 can be raised (if not previously raised) to a predetermined position for stretching the reseal membrane and loading the membrane with the desired, higher tensile stress.

Then the upper plate 158 is moved downwardly to form the partial slit in the inner surface of the reseal membrane until the stop pins 170 contact the upper surface of the base place 152. Subsequently, the plate 158 is returned to the retracted, elevated position. While the anvil 80 is still in the raised position, the formed partial slit remains open and can be cleaned as with de-ionized air. Subsequently, the anvil 80 is retracted downwardly to relieve the stress on the reseal 102. The upper plate 218 can then be taken off of the assembly to permit removal of the reseal 102.

In one form of the method contemplated by the present invention, the anvil 80 has a diameter of about 0.180 inch for engaging the membrane of an additive port type reseal, and the lance cutting edge has a width of about 0.219 inch for cutting the membrane of an additive port type reseal.

In view of the above discussion of the apparatus 150, it will be appreciated that the intermediate plate 210 and upper plate 218 function as a clamp assembly for clamping the periphery of the reseal membrane. Further, the base plate 152, adjusting disk 174, and the plates 210 and 218 function as positioning means for effecting relative movement between the anvil and the clamp assembly so as to stretch the membrane. Further, the drive means for effecting relative movement between the lance 90 on the one hand and the anvil 80, clamping assembly, and reseal 102 on the other hand may be characterized as including the base plate shafts 154, plate 158 mounted thereon, and the system (manual or automatic) for moving the plate 158 downwardly as schematically illustrated by the arrow 360 in FIG. 10. It will be appreciated, however, that the system may be modified to permit the plate 158 to remain stationary while the base plate is moved upwardly to carry with it the plates 210 and 218 and the reseal clamped therein.

Figure 12:
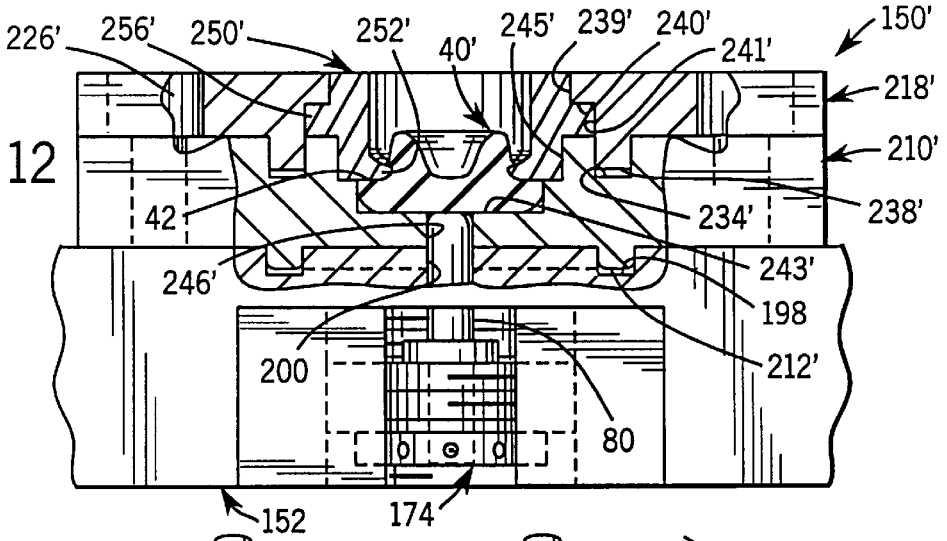
FIG. 12 is a fragmentary, side elevational view of another form of the apparatus as shown in FIG. 11 as adapted for use with a reseal of the stopper type illustrated in FIGS. 1–6, and portions of the apparatus in FIG. 12 are shown in cross section.
Figure 13:
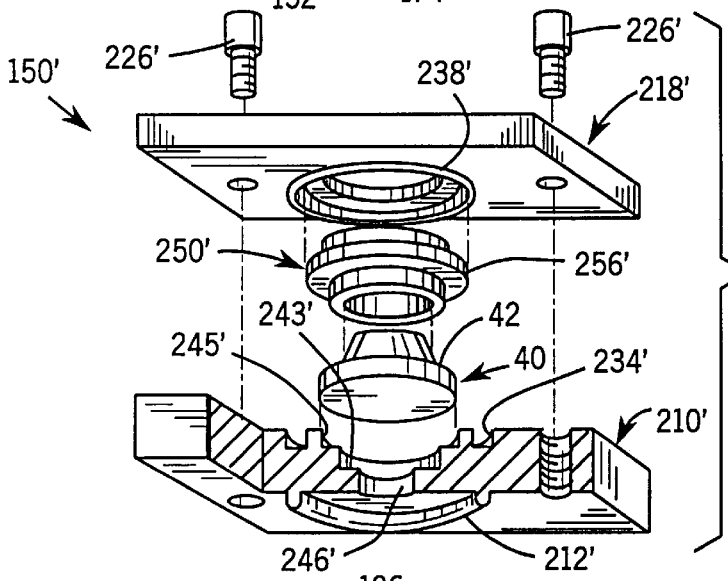
FIG. 13 is an exploded, perspective view of a portion of the apparatus shown in FIG. 12.

FIGS. 12 and 13 illustrate a modification of the apparatus for use with a reseal of the stopper type, such as the stopper reseal 40 described above with reference to FIGS. 1–6. The modified apparatus is designated generally by the reference number 150' in FIGS. 12 and 13. The apparatus 150' includes some components identical with those employed in the apparatus 150 described above with reference to FIGS. 10 and 11. In particular, the apparatus 150' includes a base plate 152 identical with the base plate 152 of the apparatus 150.

The apparatus 150' also includes the lance and lance support components which are not shown in FIGS. 12 and 13, but which are identical with the lance and lance support components described above and illustrated in FIGS. 10 and 11. In particular, with reference to FIG. 11, the lance 90, lance support 270, friction ring 272, plate 158, dial 274, stop pins 170, and mounting shafts 154 can be incorporated without modification in the apparatus 150' illustrated in FIGS. 12 and 13. Similarly, in the plate 152 of the apparatus 150', there is an anvil 80 and an adjusting disc 174 which have the same structure as, and which operate in the same manner as, those identically numbered components illustrated in FIGS. 10 and 11 and previously described with reference thereto.

Mounted to the top of the plate 152 is an intermediate plate 210' which has a downwardly projecting ring 212' received in the annual groove 198 in the top of the base plate 152. The top of the intermediate plate 210 defines an annular groove 234' for receiving an annular ring 238' projecting downwardly from the bottom of an upper plate 218'. The plates 210' and 218' are screwed together with cap screws 226' in the same manner as the plates 210 and 218 of the apparatus 150 are screwed together with cap screws 226 as described above with reference FIGS. 10 and 11.

The upper plate 218' defines a first bore 239' opening to the top of the plate 218' and defines an enlarged counter bore 241' opening to the bottom of the plate 218'. An annular shoulder 240' is defined between the bore 239' and the counterbore 241'. A retaining insert 250' is disposed within the plate bore 239' and counter bore 241'. The insert retainer ring 250' has a flange 256' seated on the annular surface 240'. The retainer ring 250' also includes an inwardly extending flange 252' which engages the stopper reseal flange 42. This holds one surface of the reseal membrane against an annular bearing surface 243' defined in the intermediate plate 210'. The intermediate plate 210' also defines a counterbore 245' for receiving an exterior portion of the insert ring flange 252' above the stopper reseal flange 42.

The intermediate plate 210' also defines a central bore 246' extending from the annular bearing surface 243' to the bottom of the plate 210'. The bore 246' is aligned with the bore 200 in the base plate 152 and is adapted to receive the upwardly projecting portion of the anvil 80.

The modified apparatus 150' is operated in substantially the same manner as the apparatus 150 described above with reference to FIGS. 10 and 11. In particular, after the reseal 40 is clamped within the plates 210' and 218' and ring 250', the anvil 80 is elevated to force the reseal membrane upwardly and stretch the reseal membrane (as diagrammatically illustrated in FIG. 5 and as described above with reference to FIG. 5). Subsequently, the lance 90 (as carried by an upper plate assembly as illustrated in FIG. 10) is moved downwardly to cut a partial slit or perforation in the membrane of the stopper reseal 40. For one presently contemplated type of stopper reseal 40, the anvil diameter may be 0.230 inch. If desired, the upper, distal end of the anvil 80 that engages the reseal 40 may be hemispherical (as illustrated in dashed lines in FIGS. 4–6), rather than substantially flat.

In the embodiment illustrated in FIGS. 12 and 13, the width of the V-shaped cutting edge of the lance is preferably about 0.375 inch for one presently contemplated size of a stopper reseal 40.

Figure 14:
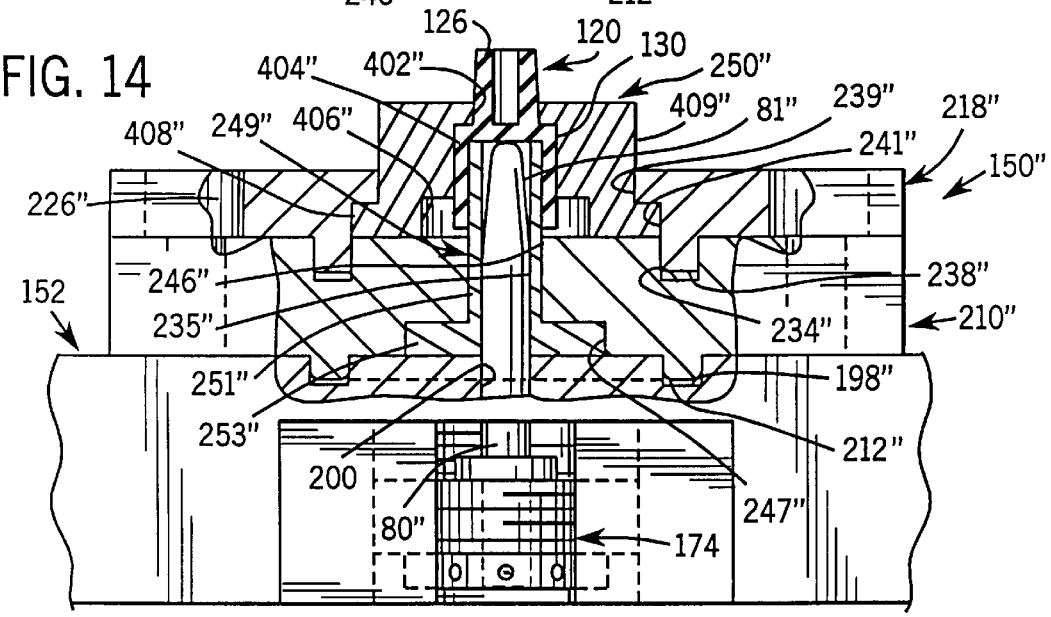
FIG. 14 is a fragmentary, side elevational view of a modified form of the apparatus adapted for use with a down port or sleeve stopper type reseal shown in FIGS. 8 and 9 and portions of the apparatus are shown in cross section in FIG. 14.
Figure 15:
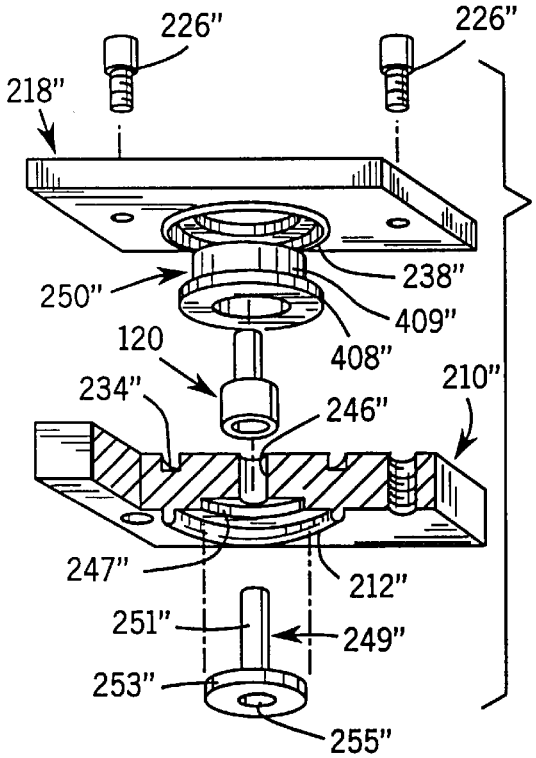
FIG. 15 is an exploded, perspective view of portions of the apparatus shown in FIG. 14.

A further modification of the apparatus 150 is illustrated in FIGS. 14 and 15 as adapted for use with a down port or sleeve stopper reseal 120 described above with reference to FIGS. 8 and 9. In FIG. 14, the modified apparatus is designated generally by a reference number 150". A number of the components of the modified apparatus 150" are identical with those previously described with reference to the embodiment 150 illustrated in FIGS. 10 and 11. With reference to the embodiment illustrated in FIGS. 10 and 11, only the anvil 80, intermediate plate 210, upper plate 218, and the components contained within the plates 210 and 218 are different in the modified apparatus 150".

In particular, the apparatus 150" includes an intermediate plate 210" having a downwardly projecting, annular ring 212" for being received in the annular groove 198 in the upper surface of the base plate 152. The intermediate plate 210" defines a bore 246" and an enlarged counterbore 247" which opens downwardly to the top of the base plate 152. The bores 246" and 247" are aligned with the base plate bore 200 for receiving the anvil 80".

The anvil 80" may have a tapered distal end portion 81" rather than a flat end as shown in FIG. 8. The major diameter of the anvil 80" is be about 0.176 inch in one presently contemplated embodiment.

Mounted within the bore 246" and counter bore 247" of the intermediate plate 210" is an anvil guide 249". The guide 249" has an upwardly projecting, hollow, cylindrical tube 251" and a base flange 253". The cylindrical tube 251' is received in the intermediate plate bore 246", and the flange 253" is received in the counterbore 247". An upper portion of the cylindrical tube 251" extends outwardly above the bore 246" and extends beyond the top of the intermediate plate 210". The guide 249" defines an internal bore 255' for receiving the anvil 80".

The upper surface of the intermediate plate 210" defines an upwardly open, annular channel or groove 234" for receiving a ring 238" projecting downwardly from the bottom of the upper plate 218". The upper plate 218" is attached to the intermediate plate 210" with a pair of cap screws 226" in substantially the same manner as the first embodiment upper plate 218 is secured to the intermediate plate 210 with cap screws 226 as described above with FIGS. 10 and 11.

The upper plate 218" defines a central bore 239" and a larger diameter counterbore 241" (FIG. 14). A reseal retaining ring 250" is mounted within the upper plate 218" around the reseal 120 which is disposed with the rollable sleeve 130 received on the distal end of the guide tube 251".

To this end, the retainer ring 250" defines an upper bore 402" for receiving the reseal plug portion 126, an intermediate bore 404" for receiving the rollable sleeve 130, and a larger diameter bore 406" opening downwardly to the upper surface of the intermediate plate 210". The retaining ring 250" includes a base flange 408" which is received within the larger diameter counter bore 241" of the upper plate 218". A reduced diameter portion 409" of the retainer ring 250" projecting upwardly from the base flange 408" is received in, and projects beyond, the upper plate bore 239".

The modified apparatus 150" may be operated in substantially the same manner as described above for the apparatus 150. In particular, the reseal 120 is disposed on the guide 249" and clamped with the retaining ring 250" by securing the upper plate 218" to the intermediate plate 210". The stop pins (not shown in FIGS. 14 and 15 but identical with the stop pins 170 described above with reference to FIGS. 10 and 11) are positioned as desired to establish a predetermined minimum elevation of the lance 90 (not shown in FIGS. 14 and 15 but substantially identical with the lance 90 described above with reference to FIGS. 10 and 11).

With the lance initially retracted to an elevated position, the anvil 80" is moved upwardly by rotating the adjusting disc 174 so as to stretch the membrane of the down port reseal 120 and subject the reseal membrane to an elevated tensile stress (as diagrammatically illustrated in FIG. 8). Then the lance is moved downwardly to cut the slit partially through the reseal membrane until the stop pins engage the top of the base plate 152. In one contemplated type of down port reseal 120, the With of the V-shaped cutting edge of the lance 90 is about 0.119 inch.

Figure 16:
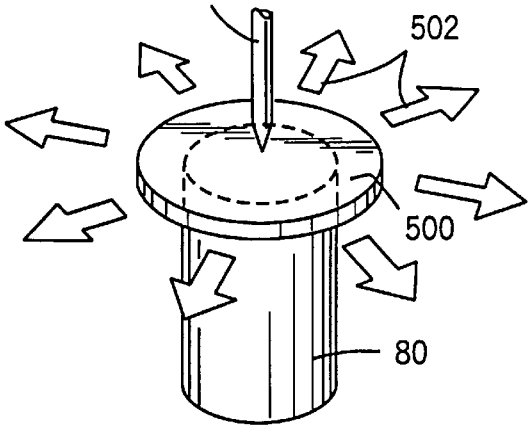
FIG. 16 is a diagrammatic or schematic, perspective view of an anvil and reseal membrane portion subjected to one form of the process of the present invention.

Another aspect of the present invention is illustrated in FIGS. 16–25. These figures diagrammatically illustrate how a reseal membrane can be stretched and cut to provide two or more partial slits or how the stretched membrane can be cut while subjecting the face of the membrane to additional loading. In particular, FIG. 16 diagrammatically illustrates a central region or membrane 500 of a reseal (the peripheral portions of the reseal have been omitted). The reseal membrane 500 is subjected to radial forces (indicated by the arrows 502) to stretch the membrane. This imposes tensile stresses on the membrane, and at least a component of these tensile stresses acts generally along the plane of the membrane.

Figure 17:
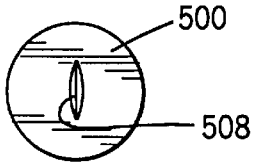
FIG. 17 is a plan view of a membrane region of a reseal under tension showing an open, partial perforation.

This tensile stress loading of the reseal membrane 500 may be effected with any suitable type of apparatus (e.g., apparatus 150, 150', and 150" discussed above with reference to FIGS. 10–15) wherein a peripheral portion of the reseal can be clamped or otherwise restrained while an anvil 80 is pushed upwardly against the reseal membrane 500 to effect a stretching of the membrane 500. While the membrane is stretched, and while it is subjected to a substantially uniform, radial tensile stress, the lance 90 can be advanced into the membrane 500 to cut partially through the membrane. This is illustrated in FIG. 17 by the cut 508, and the cut 508 remains open after removal of the lance 90 so long as the membrane 500 remains subjected to the radial tensile stress.

Figure 18:
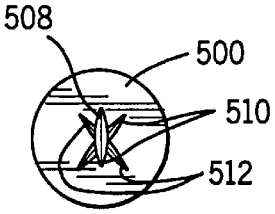
FIG. 18 is a view similar to FIG. 17, but FIG. 18 shows two additional perforations.
Figure 19:
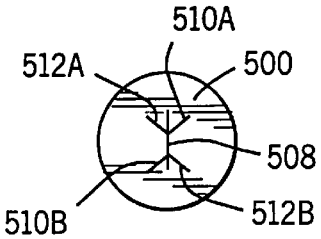
FIG. 19 is a view similar to FIG. 18, but FIG. 19 shows the membrane portion of the reseal in a substantially relaxed and unstressed condition.

As shown in FIG. 18, one or more additional cuts may be made in the membrane 500. FIG. 18 shows an additional second cut 510 and an additional third cut 512. All three cuts 508, 510, and 512 are made while the membrane 500 is stretched. When the stretching forces on the membrane are released, the membrane 500 relaxes and returns to a substantially unstressed, relaxed condition, as illustrated in FIG. 19. In the unstressed condition, the slits close. In the unstressed condition, the end portions of the second and third slits 510 and 512 become separated. In FIG. 19, the left-hand end of the cut 510 in the relaxed membrane is designated 510B, and the right-hand end of the cut 510 is designated 510A. Similarly, the left-hand end of the cut 512 in the relaxed membrane is designated as 512A, and the right-hand end of the cut 512 is designated as 512B. The three-cut configuration illustrated in FIG. 19 can more effectively cover a generally circular target region or zone.

Figure 20:
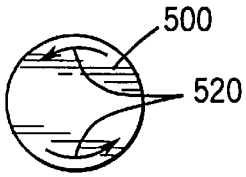
FIG. 20 is a diagrammatic view of a central portion or membrane of a reseal subjected to loads which stretch the membrane radially and subjected to a torque load applied to one face of the membrane.
Figure 21:
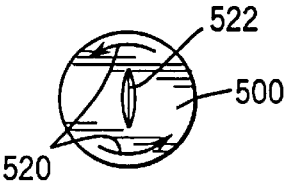
FIG. 21 is a view similar to FIG. 20, but FIG. 21 shows the formation of a partial perforation in the reseal under load.

FIG. 20 illustrates the application of torque load to one face of the membrane 500. The membrane is stretched, as with an anvil 80, as shown in FIG. 16, and simultaneously the anvil, while in frictional engagement with the membrane, can be rotated (e.g., typically less than 2 $\pi$ radians) so as to impart some amount of angular displacement to the membrane 500 as indicated by the arrows 520 in FIG. 20. Then the lance 90 can be advanced to produce a cut 522 in the membrane 500.

Figure 22:
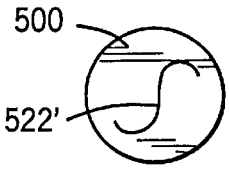
FIG. 22 is a view similar to FIG. 21, but FIG. 22 shows the membrane in a substantially relaxed and unstressed condition.

After the lance 90 is withdrawn and after the tensile and torsion loads are removed, the membrane 500 returns to its unstressed condition, as illustrated in FIG. 22, and the cut 522 closes to assume a generally S-shaped configuration 522'. This configuration can cover a larger area than a simple straight cut.

Figure 23:
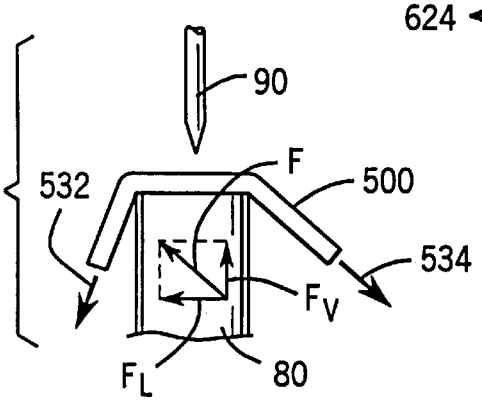
FIG. 23 is a diagrammatic or schematic side elevational view of a portion of a reseal central region or membrane subjected to a radial force or transverse stretching force while a shear force is applied to one side surface of the membrane.
Figure 24:
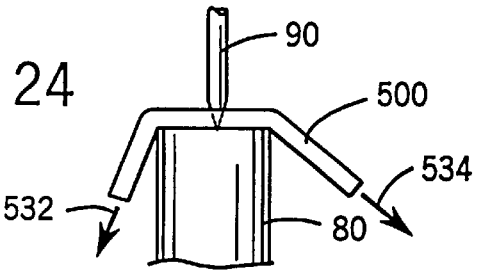
FIG. 24 is a view similar to FIG. 23, but FIG. 24 shows the penetration of the stressed membrane with a cutting edge of a lance.
Figure 25:
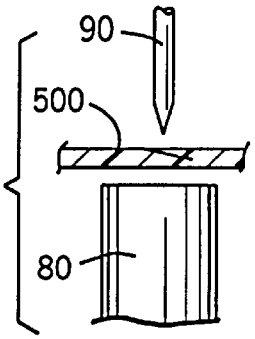
FIG. 25 is a view similar to FIG. 24, but at a subsequent step in the process with the membrane substantially relaxed and unstressed and with the lance withdrawn from the membrane.

FIGS. 23–25 illustrate the formation of another partial perforation in a reseal membrane 500 under different loading-conditions. As illustrated in FIG. 23, an anvil is moved against the underside of the reseal membrane 500 which is restrained at its periphery as indicated by the arrows 532 and 534. The anvil 80 is initially moved against the reseal membrane 500 along a substantially axial line of action and engages the reseal membrane 500 substantially in the central region of the reseal in a manner similar to that illustrated in FIG. 16. Subsequently, with the distal end surface of the anvil 80 frictionally engaged with the lower surface of the membrane 500, the anvil 80 is also moved laterally. At least a component of the motion of the anvil 80 is lateral. This establishes a force F having a vertical component $F_V$ and a lateral component $F_L$. This tends to move a lower portion of the membrane laterally relative to the upper surface of the membrane. Thus, the cross section of the membrane 500 is subjected to a shear loading. Then, with the membrane 500 subjected to the shear loading, the lance 90 is advanced into the membrane to make a partial perforation or cut as illustrated in FIG. 24.

Subsequently, the lance 90 is retracted, the anvil 80 is disengaged from the reseal membrane 500, and the loads are removed from the reseal membrane. The reseal membrane 500 thus returns to its relaxed, unstressed condition. The shear stress across the thickness of the membrane goes to zero, and the cut assumes an angled or oblique configuration relative to the planar surfaces of the membrane 500. The closed cut is at an angle generally opposite to the angle of the shear force gradiant across the membrane thickness as established under the load illustrated in FIG. 23. The angled cut can provide an enhanced reseal or self-seal compared to a vertical, straight cut.

FIGS. 26–31 illustrate the use of a plurality of lances for creating partial perforations or cuts in a reseal membrane.

FIGS. 26–31 illustrate a modification of the apparatus for use with a reseal of the additive port type. The additive port is designated generally by the reference numeral 102 in FIG. 26, and the apparatus is designated generally by the reference numeral 150'''. The apparatus 150''' includes some components identical with those employed in the apparatus 150 described above with reference to FIGS. 10 and 11. In particular, the apparatus 150''' includes a base plate 152, anvil 80, and adjusting disk 174 which are each identical with the identically numbered components of the apparatus 150.

The modified apparatus 150''' also includes a lance support plate 158 which is identical with the lance support plate 158 in the embodiment 150 illustrated in FIGS. 10 and 11. The lance support plate carries a dial (not shown in FIG. 28, but identical with the dial 274 described above with reference to FIG. 11). The lance support plate 158 is mounted for movement upwardly and downwardly on posts (not shown, but identical with the posts 154 described above with reference to FIG. 11).

The apparatus 150''' also includes an intermediate plate 210, an upper plate 218, a friction ring 272, and a support ring 250 which are the same as the identically numbered components described above with reference to FIG. 11.

The apparatus 150''' includes a lance holder 270 for holding four lances 90'''. The lance holder 270''' includes a flange 300''' received in the counterbore 282 in the bottom of the plate 158 along with a friction ring 272.

Figure 27:
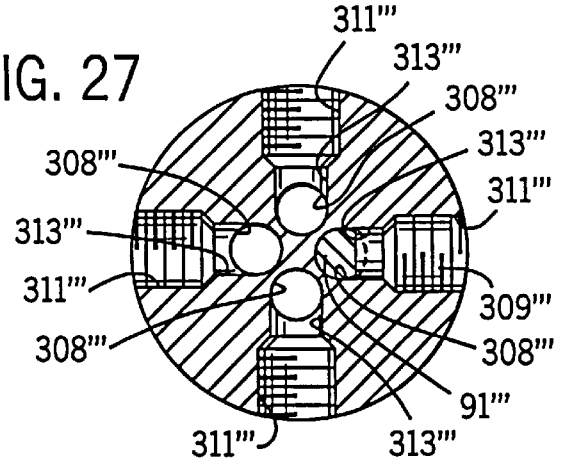
FIG. 27 is a greatly enlarged, cross-sectional view taken generally along the plane 27—27 in FIG. 26.
Figure 31:
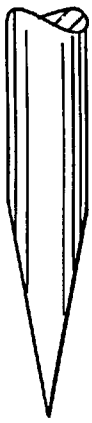
FIG. 31 is a fragmentary side view taken generally along the plane 31—31 in FIG. 28.

The lance holder 270 includes a central, cylindrical portion 304''' which projects downwardly from the flange 300''' on the interior of the friction ring 272. The portion 304''' defines four, downwardly open bores 308''' for receiving the lances 90'''. Each lance 90''' is received in one of the bores 308'''. Each lance 90''' is maintained within a bore 308''' at a desired elevation by means of a set screw 309'''. To this end, the portion 304''' of the lance holder 270''' defines four, radially oriented, threaded bores 311''' (FIG. 27). Each bore 311''' has a reduced diameter inner portion 313''' communicating with a vertical bore 308'''. Each set screw 309''' includes a reduced diameter distal end portion for being received in the smaller diameter bore 313''' to engage the side of an lance 90'''.

In the preferred embodiment illustrated, each lance 90''' has a reduced diameter neck portion 602''' (FIGS. 26 and 28), and the reduced diameter neck portion 602''' is disposed within the associated bore 308''' and clamped by the associated set screw 309'''. Each lance 90''' has a flat notch 604 in the neck portion 602 for being engaged by the distal end of a set screw 309'''.

FIGS. 28–31 illustrate a novel shape of each lance 90''' below the neck 602. This portion is designated by number 610. The portion 610 defines a generally semi-cylindrical surface on one side and a generally V-shaped surface 616 on the other side. A shape blade is defined at the bottom distal end.

The portion of the lance holder 270''' above the flange 300''' has the same structure as the lance holder 270 described above with reference to FIGS. 10 and 11. The lance-holder 270''' is adjustably retained in the plate 158 in the same manner as the lance holder 270 described above with reference to FIGS. 10 and 11.

Figure 30:
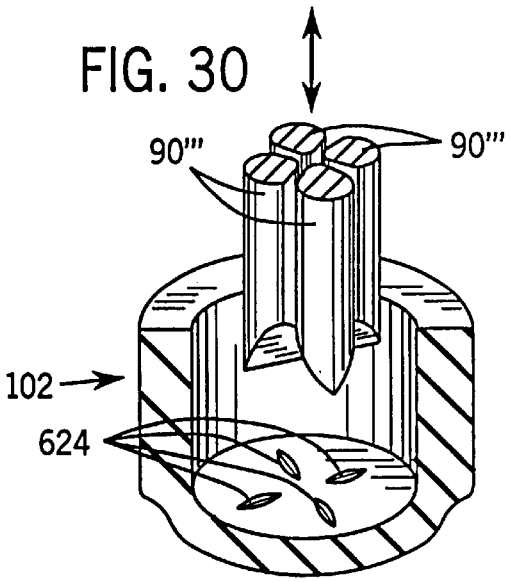
FIG. 30 is a fragmentary, perspective view of four lances in a retracted position relative to an additive port reseal.

In operation, the plate 158 is lowered to drive the lances 90''' partially into the diaphragm of the reseal 102. This causes four partial cuts 624 to be made in the diaphragm as illustrated in FIG. 30. The cuts are made while the diaphragm of the reseal is stretched by the anvil in the same manner as described above with respect to the cutting of the diaphragm 102 illustrated in FIGS. 10 and 11.

When the four lances 90''' are retracted from the reseal diaphragm, the diaphragm can still be maintained in a stretched condition to hold the cuts open as illustrated in FIG. 30. This permits the cuts to be cleaned, as with de-ionized air.

It will be appreciated that other configurations of multiple cuts may be provided (e.g., as by increasing or decreasing the number of lances 90''' and/or by changing the orientation of one or more of the lances 90''').

It will be readily apparent from the foregoing detailed description of the invention and from the illustrations thereof that numerous variations and modifications may be effected without departing from the true spirit and scope of the novel concepts or principles of this invention.

What is claimed is:

1. A method for creating a partially perforated elastic seal membrane in a reseal comprising the steps of:

(A) restraining said reseal and applying radial tensile forces to said membrane with said radial tensile forces having first components acting in directions generally perpendicular to a first surface of said membrane and second components acting in at least two different directions that are generally parallel to said first surface of said membrane;

(B) effecting partial penetration of said membrane by engagement of at least one cutting edge with a second surface of said membrane, said second surface located opposite said first surface, said partial penetration being formed through the second surface to a predetermined distance from said first surface and traversing the direction of at least one of said second components of said radial tensile forces; and (C) disengaging said cutting edge from said membrane and terminating the application of said radial tensile forces to said membrane.

2. The method in accordance with claim 1 wherein the membrane is formed of a material defined by an ultimate stress and the applied radial tensile forces define a tensile stress in the membrane, and further wherein said step (A) is effected to elevate the tensile stress in said membrane to less than, and within 10% of, the ultimate stress of the membrane material.

3. The method in accordance with claim 1 in which said step (A) is effected by restraining a peripheral portion of said reseal and positioning an anvil against said first surface of said membrane to stretch said membrane.

4. The method in accordance with claim 1 in which said step (B) includes advancing said cutting edge into said membrane from the second surface toward the first surface wherein the predetermined distance of the partial penetration is formed to at least about 0.03 inches from the first surface.

5. The method in accordance with claim 1 in which said step (B) includes providing said cutting edge with a generally V-shaped traverse profile and advancing said cutting edge into said membrane.

6. The method in accordance with claim 1 in which said step (B) includes advancing said at least one cutting edge at more than one location into said membrane.

7. The method in accordance with claim 6 in which step (B) includes advancing one cutting edge into said membrane at a first location, step (C) includes withdrawing said one cutting edge from said membrane at said first location, step (B) includes subsequently advancing said one cutting edge into said membrane at a second location, and step (C) includes withdrawing said one cutting edge from said membrane at said second location.

8. The method in accordance with claim 6 in which step (B) includes advancing a plurality of cutting edges into said membrane.

9. The method in accordance with claim 1 in which step (A) includes applying said tensile forces so as to subject said membrane to a substantially uniform radial stress.

10. The method in accordance with claim 1, wherein the membrane and the at least one cutting edge are rotated relative to each other as the partial penetration is being formed.

11. The method in accordance with claim 1, wherein the membrane and the at least one cutting edge are moved transversely relative to each other as the partial penetration is being formed.

12. A method for creating a partially perforated elastic seal membrane in a reseal comprising the steps of:

(A) stretching said membrane by restraining said reseal and positioning an anvil against a first surface of said membrane to apply radial tensile forces to said membrane, said radial tensile forces having first components acting in directions generally perpendicular to said first surface of said membrane and second components acting in at least two different directions that are generally parallel to said first surface of said membrane; and (B) effecting partial penetration of said membrane by engagement of at least one cutting edge with a second surface of said membrane, said second surface located opposite said first surface, said partial penetration being formed through the second surface to a predetermined distance from said first surface and traversing the direction of at least one of said second components of said radial tensile forces.

13. The method in accordance with claim 12 wherein the membrane is formed of a material defined by an ultimate stress and the applied radial tensile forces define a tensile stress in the membrane, and further wherein step (A) is effected to elevate the tensile stress in said membrane to less than, and within 10% of, the ultimate stress of the membrane material.

14. The method in accordance with claim 12 in which said step (B) includes advancing said cutting edge into said membrane toward the first surface wherein the predetermined distance of the partial penetration is formed to at least about 0.03 inches from the first surface.

15. The method in accordance with claim 12, wherein the membrane and the at least one cutting edge are rotated relative to each other as the partial penetration is being formed.

16. The method in accordance with claim 12, wherein the membrane and the at least one cutting edge are moved transversely relative to each other as the partial penetration is being formed.

* * * * *